US006694573B2

(12) United States Patent
Matsushima

(10) Patent No.: US 6,694,573 B2
(45) Date of Patent: Feb. 24, 2004

(54) SNAP WITH SUPPORTS

(75) Inventor: Hideyuki Matsushima, Toyama-ken (JP)

(73) Assignee: YKK Corporation, Tokyo (JP)

( * ) Notice: Subject to any disclaimer, the term of this patent is extended or adjusted under 35 U.S.C. 154(b) by 73 days.

(21) Appl. No.: 09/840,112

(22) Filed: Apr. 24, 2001

(65) Prior Publication Data

US 2001/0034927 A1 Nov. 1, 2001

(30) Foreign Application Priority Data

Apr. 28, 2000 (JP) ..... 2000-130653

(51) Int. Cl.[7] ..... A44B 1/34

(52) U.S. Cl. ..... 24/114.4; 24/90.1; 24/114.05; 24/682.1

(58) Field of Search ..... 24/90.1, 305, 114.4, 24/104, 306, 114.05, 114.8, 681, 682.1, 683, 629, 662

(56) References Cited

U.S. PATENT DOCUMENTS

| | | | | | |
|---|---|---|---|---|---|
| 1,037,499 | A | * | 9/1912 | Lecoutre | 24/697.1 |
| 1,253,521 | A | * | 1/1918 | Ozanne | 24/697.1 |
| 3,200,464 | A | * | 8/1965 | Cousins | 24/230 |
| 3,612,381 | A | * | 10/1971 | Schmidt | 227/18 |
| 3,751,770 | A | * | 8/1973 | Italiano | 24/697.1 |
| 3,807,482 | A | * | 4/1974 | Baker, Sr. | 160/330 |
| 4,183,121 | A | * | 1/1980 | Cousins | 24/588.1 |
| 4,251,311 | A | * | 2/1981 | Lemelson | 156/380.6 |
| 4,296,533 | A | * | 10/1981 | Doerter | 24/581.1 |
| 4,350,656 | A | * | 9/1982 | Moertel | 264/166 |
| 4,785,508 | A | * | 11/1988 | Takeda | 24/114.05 |
| 4,825,516 | A | * | 5/1989 | Ackermann et al. | 24/114.05 |
| 5,655,268 | A | * | 8/1997 | Keyaki et al. | 24/104 |
| 5,758,589 | A | | 6/1998 | Pommier | |
| 5,829,105 | A | * | 11/1998 | Matoba et al. | 24/115 F |
| 6,058,577 | A | * | 5/2000 | Ida et al. | 24/306 |
| 6,161,361 | A | * | 12/2000 | Ehrenkrantz | 52/731.9 |
| 6,182,338 | B1 | * | 2/2001 | Watanabe | 24/399 |
| 6,243,927 | B1 | * | 6/2001 | Matsushima et al. | 24/401 |
| 6,260,240 | B1 | * | 7/2001 | Akashi et al. | 24/114.4 |

FOREIGN PATENT DOCUMENTS

| | | |
|---|---|---|
| JP | 56-16311 | 2/1981 |

* cited by examiner

*Primary Examiner*—Robert J. Sandy
*Assistant Examiner*—André L. Jackson
(74) *Attorney, Agent, or Firm*—Finnegan, Henderson, Farabow, Garrett, & Dunner, L.L.P.

(57) ABSTRACT

This invention intends to provide a snap with supports, the snap being formed of resin across a pair of tapes in a simple manner thereby leading to improvement of productivity and securing a solid structure and practical performance. Supports such as tapes are disposed in parallel with a gap. By using this gap, male bodies or female bodies of the snaps of thermoplastic resin are formed across opposing edges of the tapes opposing each other at a predetermined pitch by injection molding means or extrusion molding means. A string may be used as the support. Different from a conventional processing in which an attaching hole is made in the center of the tape and resin snap is formed therein, a boring step is not necessary. Thus, this snap with tapes is created through such a simple processing.

7 Claims, 7 Drawing Sheets

SNAP WITH SUPPORTS

BACKGROUND OF THE INVENTION

1. Field of the Invention

The present invention relates to a snap formed in the form of a male body and a female body and more particularly to a snap with supports for use in a fastening device of clothes, an opening/closing device of curtain and the like.

2. Description of the Related Art

Conventionally, in a known snap with tapes of this type, an attaching hole is made in the center of the tape at a predetermined pitch in order to attach the snaps on the tape. Then, a male body or a female body of the snap formed of thermoplastic resin is attached on this attaching hole in the tape by integral molding by injection molding means.

According to Japanese Utility Model Laid-Open Publication No. 56-16311, as shown in FIG. 13, a tape-like foundation cloth 6' is woven or knitted such that that weave pattern or stitch in the center in the width direction is rough while the weave pattern or stitch on both side portions is fine. Then, a male body or a female body of a snap 1' of thermoplastic resin is attached in the rough weave pattern portion or rough stitch portion in the center at a predetermined pitch by injection molding means using synthetic resin.

Because the snap with tapes of the first example described above needs to be provided with attaching holes in the tape in order to attach a male body or a female body on the tape at a predetermined pitch, a hole boring step is required for attaching the snaps, which is a troublesome work. Further, it is also troublesome to align a cavity with the attaching hole at the predetermined pitch.

Further, the snap with tapes shown in FIG. 13 must be woven or knitted such that the tape-like foundation cloth is rough in the center thereof while both side portions are fine. Therefore, production of such a tape-like foundation cloth is troublesome. Further, because the male body or female body of the snap is formed of synthetic resin in the rough weave pattern portion or stitch portion of the tape-like foundation cloth, the fixing strength of the snap is not enough. Thus, this snap with tapes is not suitable for practical use.

SUMMARY OF THE INVENTION

The present invention has been achieved in views of the above described problems. An object of the present invention is to provide a snap with supports in which any troublesome processing such as boring is not necessary and existing tapes, but not special tape or strings are disposed as supports in parallel to have a predetermined gap between the supports and snaps are molded of thermoplastic resin in this gap by injection molding means or extrusion molding means. That is, an object of the invention is to provide a snap with supports, in which a plurality of snaps are attached along long tapes or the strings as supports at a predetermined pitch. Thus, the snaps are attached very easily, thereby leading to improvement of productivity and provision of a solid snap with supports having the practical performance.

Another object of the invention is to provide a snap with supports, the snaps of thermoplastic resin being attached onto opposing tapes or strings firmly and effectively.

Another object of the invention is to provide a snap with supports in which the male body or the female body of the snap to be attached on the opposing tapes or strings can be selected depending on application purpose and configuration.

Another object of the invention is to provide a snap with supports, the snap of thermoplastic resin being attached firmly on the opposing supports, particularly, tapes and more specifically a snap with supports having a structure suitable for a large size snap.

Another object of the invention is to provide a snap with supports in which the male body or the female body of the snap of thermoplastic resin to be attached on the supports of the opposing tapes or strings has the most optimum structure.

Another object of the invention is to provide a snap with supports capable of preventing itself from floating or undulating when edges of the opposing tapes are sewed on clothes.

To achieve the above object, according to the main aspect of the invention, there is provided a snap with supports, the snap being attached by integral molding means using thermoplastic resin on opposing edges of supports disposed in parallel opposing each other across a constant gap such that the snap is molded at a predetermined pitch utilizing the gap so as to nip the supports. Thus, by disposing the supports in parallel with the gap and then using this gap, the thermoplastic resin snap can be formed integrally easily. Consequently, a processing for boring an attaching hole in the support is not necessary and it is not necessary to form a tape having a special structure hard to produce. Molding pitch can be selected freely and the molding can be achieved easily, thereby leading to improvement of productivity.

Preferably, the gap formed between the opposing supports disposed in parallel have a distance, that is, a gap which is at least larger than the size of an engaging head on a male body or an engaging hole in a female body of the snap. Consequently, this is an ideal condition not necessitating secondary processing, which enables efficient molding.

Preferably, the opposing supports disposed in parallel are formed of tapes. Alternatively, the opposing supports disposed in parallel are formed of strings. Consequently, the snap of thermoplastic resin can be formed easily without conducting special treatment on the tape or string used as a support, and thus, a high quality product can be produced.

Preferably, the opposing edge of each of the tapes disposed in parallel is formed in an enlarged edge portion. Consequently, the thermoplastic resin snap can be attached firmly with a simple structure, so that a solid, good-appearance product can be produced.

Preferably, either male bodies or female bodies of the snaps are disposed on the opposing edges of the opposing supports disposed in parallel. Alternatively, the male bodies and female bodies of the snaps are disposed alternately on the opposing edges of the opposing supports disposed in parallel. Consequently, one product composed of a set of two supports, which has no restriction in engaging positions, and another product composed of one support which can be easily used solely and in various forms depending on application purpose are provided.

Preferably, a through hole is provided in the vicinity of each of the opposing edges of the supports disposed in parallel and a nipping portion of the snap is formed on each of the through holes. Consequently, a large-size snap of thermoplastic resin can be attached firmly to the tape with a good appearance, thereby leading to increase of demand for the snap with supports.

Also preferably, the male body of the snap to be attached on the opposing edges of the opposing supports disposed in parallel has an engaging post provided in the center of a flat base having nipping portions on both sides thereof, the engaging post including an engaging head provided on an outer peripheral face such that they are protruded, and the female body of the snap has the engaging hole provided in the center of the base having nipping portions on both sides thereof, the engaging hole being capable of engaging with the engaging head and having a protruded row provided laterally in a peripheral wall of the engaging hole. Consequently, the thermoplastic resin snap can be attached in an ideal manner to the tapes or strings disposed in parallel and further, this snap is produced as a final product which can be used easily.

Also preferably, the male bodies or/and female bodies of the snaps are disposed on the opposing edges of the opposing supports disposed in parallel and small bridge pieces of thermoplastic resin are disposed on the opposing edges such that they are located between the longitudinally adjacent snaps simultaneously with the molding of the snaps. Consequently, when this snaps are attached to an attaching portion of an opening/closing portion of clothes, this structure prevents the opposing edges of the snap from floating or undulating.

DESCRIPTION OF THE PREFERRED EMBODIMENTS

Hereinafter, the embodiments of a snap with supports of the present invention will be described in detail with reference to the accompanying drawings.

Figure 1:
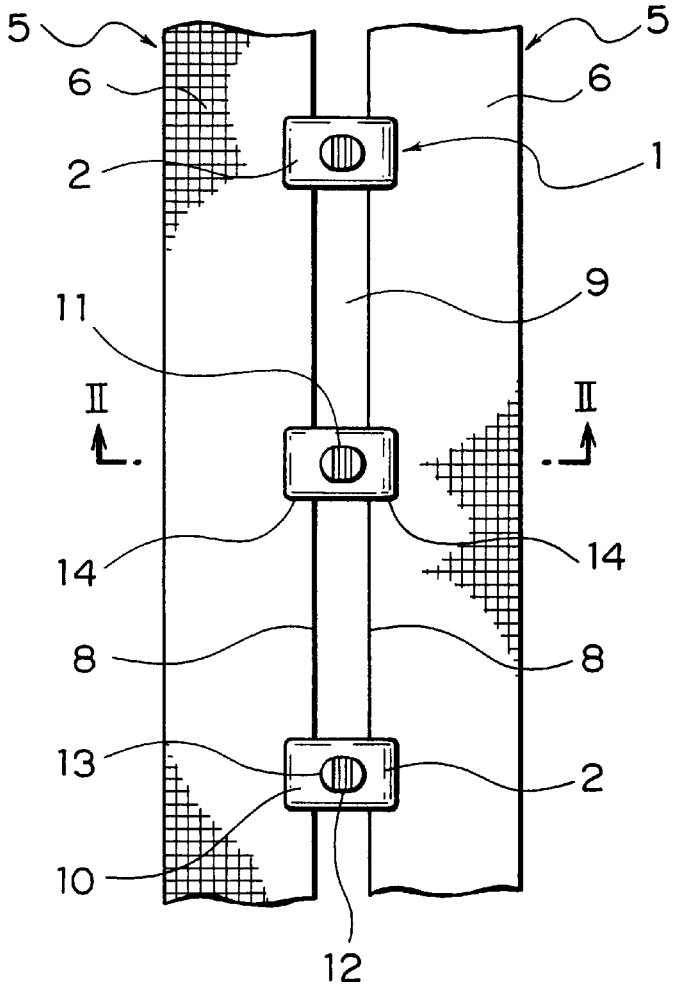
FIG. 1 is a front view of a snap with supports provided with a male body of the snap according to a first embodiment of the present invention.
Figure 2:
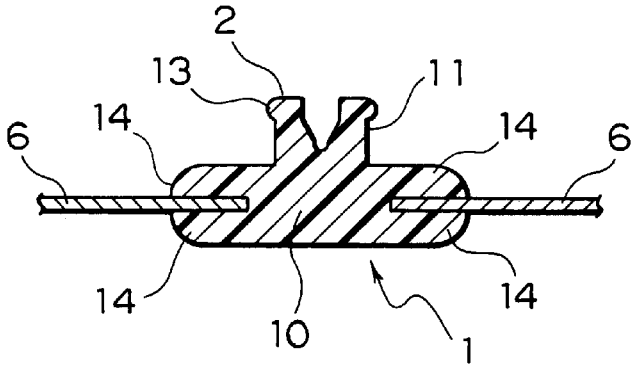
FIG. 2 is an enlarged sectional view taken along the line II—II of the snap with support of FIG. 1.
Figure 3:
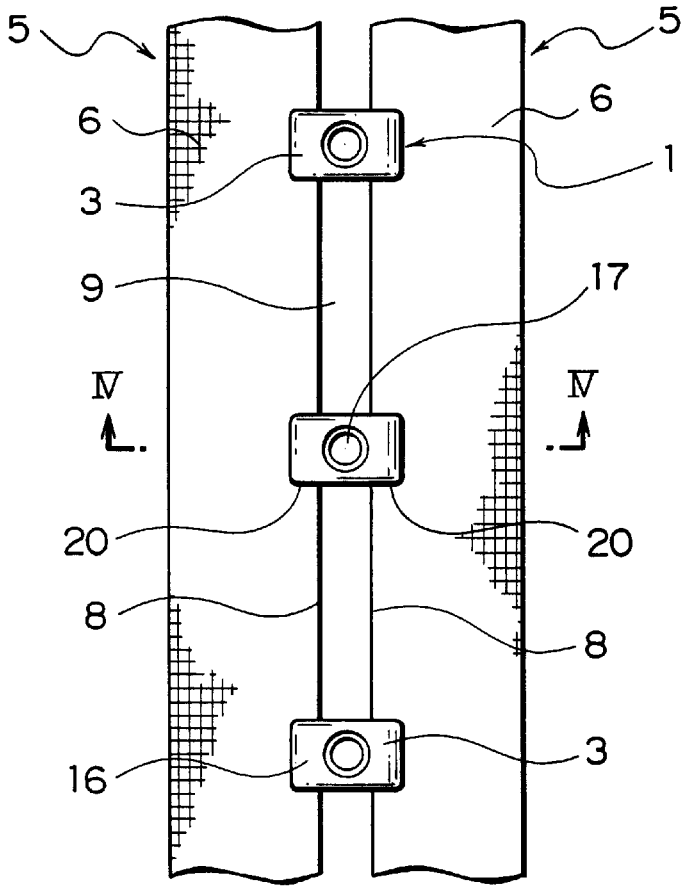
FIG. 3 is a front view of the snap with supports provided with a female body of the snap.

In the snap with supports according to the first embodiment of the present invention as shown in FIGS. 1 to 4, a tape 6 is used for the support 5 and two tapes 6 are arranged in parallel such that opposing edges 8 of the tapes 6 oppose each other across a predetermined gap 9 as shown in FIG. 1. Then, male bodies 2 of the snaps 1 are attached across the opposing edges 8 of the tapes 6 at a predetermined pitch in a length direction of the tape 6. And as shown in FIG. 3, female bodies 3 of the snaps 1 are attached across the opposing edges 8 of the tapes 6 disposed in parallel with a predetermined gap 9, such that the female bodies 3 of the snaps 1 are arranged at a predetermined pitch in the length direction of the tape 6.

Although according to this embodiment, the male bodies 2 and the female bodies 3 of the snaps 1 are attached at the constant pitch, they may be attached at any repetitive pitch in which the pitch interval repeats a large interval and a short interval.

The tape 6 of the support 5 is of cloth formed of woven fabric or knitted fabric produced by weaving or knitting synthetic fiber such as polyamide based fiber, polyester based fiber or polypropylene based fiber with weaving means and knitting means respectively. The male bodies 2 of the snaps 1 are formed integrally at the opposing edges 8 of the tapes 6 arranged in parallel such that they oppose each other, with injection molding means or extrusion molding means using thermoplastic resin such as polyamide, polyacetal, polypropylene, polybutylene terephthalate.

In the male body 2 of the snap 1 to be attached on the tapes 6 which are the opposing supports 5, as shown in FIG. 1, a flat rectangular base 10 is provided across the opposing edges 8 of the tape 6, and as shown in FIG. 2, a cylindrical engaging post 11 is provided in the center of the base 10. An expanding slot 12 having a substantially V-letter shape is provided in a top end of this engaging post 11, so that elastic force acting to the right and left is applied. Engaging heads 13 protruded outward are formed on an outer peripheral face of the engaging post 11. Nipping portions 14 for nipping the tape 6 from up and down are formed on both sides of the base 10 so as to support the base 10 between the tapes 6. The gap 9 is formed between the opposing edges 8 of the tapes 6 opposing each other and desired to be at least larger than the size of the engaging head 13 on the engaging post 11 provided on the base 10.

Figure 4:
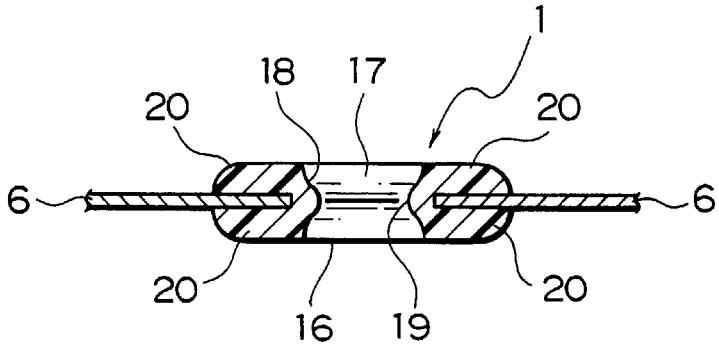
FIG. 4 is an enlarged sectional view taken along the line IV—IV of the snap with support of FIG. 3.

On the other hand, in the female body 3 of the snap 1 to be attached on the tapes 6 which are the supports 5 opposing each other, as shown in FIG. 3, a flat rectangular base 16 is provided across the opposing edges 8 of the tapes 6 and as shown in FIG. 4, a circular engaging hole 17, with which the engaging head 13 of the male body 12 engages, is formed in the center of the base 16. A protruded row 19 is provided on the center of a peripheral wall 18 of this engaging hole 17 such that it is protruded inward. When the engaging head 13 of the male body 2 engages with this hole 17, it fits firmly. Further, nipping portions 20 for nipping the tape 6 from up and down are formed on both sides of the base 16 so as to support the female body between the tapes 6. The gap 9 between the opposing edges 8 of the tapes 6 opposing each other is desired to be at least larger than a diameter of the engaging hole 17 made in the base 16.

The male body 2 of the snap 1 attached on the opposing edges 8 of the tapes 6 which are the opposing supports 5, and the female body 3 of the snap 1 attached on the opposing edges 8 of the opposing tapes 6 are used as the snap with supports acting as a pair. Therefore, the male bodies 2 and the female bodies 3 of the snaps 1 are attached on the tapes 6 at the same pitch. The tape 6 as the support 5 may be formed of unwoven cloth of synthetic fiber, thermoplastic resin film or synthetic leather.

As described above, the tape 6 is used for the support 5 and the predetermined gap 9 is provided between the opposing tapes 6, such that for the male portion 2 of the snap 1, that gap 9 is larger than the diameter of the engaging head 13 and for the female portion 3, larger than the diameter of the engaging hole 17. As compared to the conventional product in which an attaching hole is made in the tape and the snap is formed in this attaching hole, according to the present invention, in order to attach the snap 1 on the tape 6, two tapes 6 are arranged in parallel with the predetermined gap 9 and the male boy 2 and the female body 3 of the snap 1 are formed integrally at the constant pitch or any other pitch.

Figure 5:
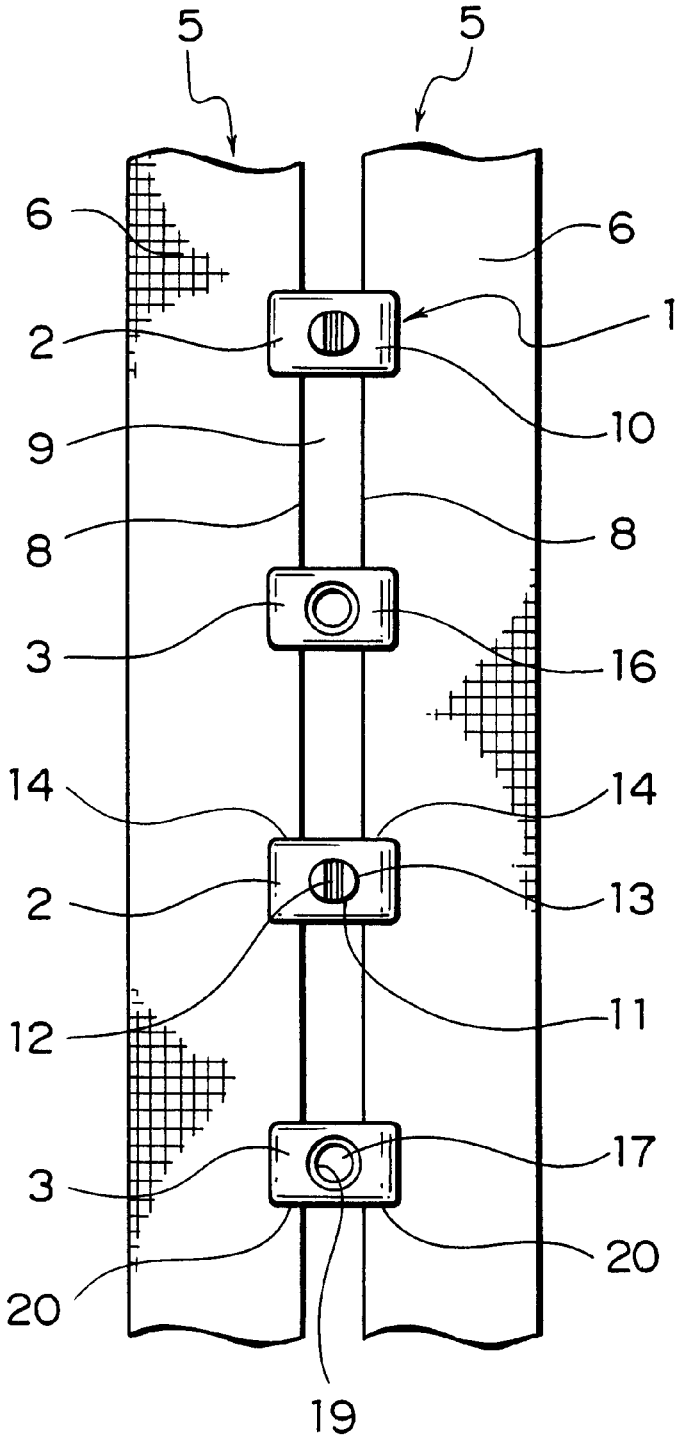
FIG. 5 is a front view of a snap with supports in which a male body and a female body are disposed alternately according to a second embodiment of the present invention.

In the snap with supports according to the second embodiment shown in FIG. 5, the tape 6 is used for the support 5 and the gap 9 is provided at a predetermined interval between two tapes 6. Then, the male bodies 2 and the female bodies 3 of the snaps 1 are attached on the opposing edges 8 of the tapes 6 alternately at a predetermined pitch. As for the configuration of the snap 1, the male bodies 2 and female bodies 3 of the snap 1 which are the same as those of the first embodiment are attached integrally.

This snap with supports is used in a single strap as a product, different from the snap with supports of the first embodiment. Upon use, the support 5 may be bent such that the male body 2 and the female body 3 of the snap 1 correspond to each other or the support 5 may be cut out to an appropriate length such that the male body 2 and the female body 3 correspond to each other.

Figure 6:
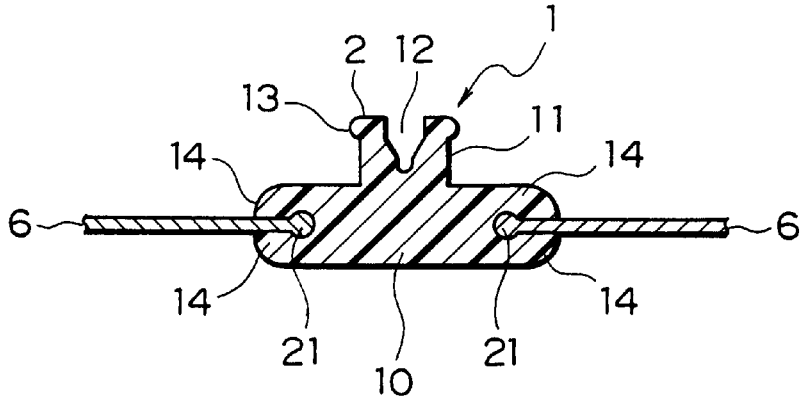
FIG. 6 is a cross sectional view of a snap with supports according to a third embodiment of the present invention.

In the snap with supports according to a third embodiment shown in FIG. 6, the tape 6 used for the support 5 is modified. A bead-like enlarged edge portion 21 is formed integrally on each of the opposing edges 8 of the tapes 6 such that they oppose each other on the opposing tapes 6. By provision of the bead-like enlarged edge portions 21 on the opposing edges 8 of the tape 6, the nipping portions 14 of the male body 2 of the snap 1 and the nipping portions 20 of the female body 3 are fixed firmly, so that the male body 2 and the female body 3 of the snap 1 never slip out of the tape 6.

Figure 7:
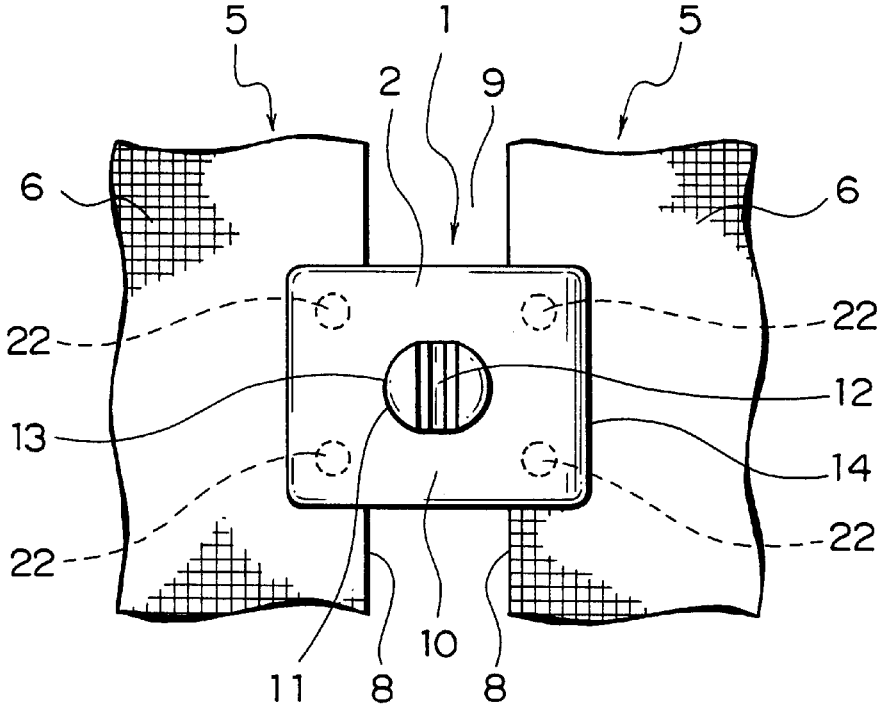
FIG. 7 is an enlarged front view of main portions of a snap with supports according to a fourth embodiment of the present invention.

In the snap with supports according to a fourth embodiment shown in FIG. 7, two tapes 6 as the supports 5 are disposed with a predetermined distance or a gap 9 such that they are arranged in parallel. Then, a male body 2 of the snap 1 made of thermoplastic resin is attached on opposing edges 8 of the tapes 6 disposed in parallel by integral molding. Two circular through holes 22 are made in the vicinity of each of the opposing edges 8 of the tape 6 and square nipping portions 14 of the male body 2 are disposed on the through holes 22. Front and rear portions of the nipping portions 14 are joined through the through holes 22 so as to attach the male body 2 of the snap 1 on the opposing edges 8 of a pair of the tapes 6. If this type of the snap is applied for fixing of a large size snap 1, the snap 1 can be fixed to the tapes 6 firmly. Of course, this snap can be applied to a small size snap 1 and this structure may be applied to the female body 3 of the snap 1.

Figure 8:
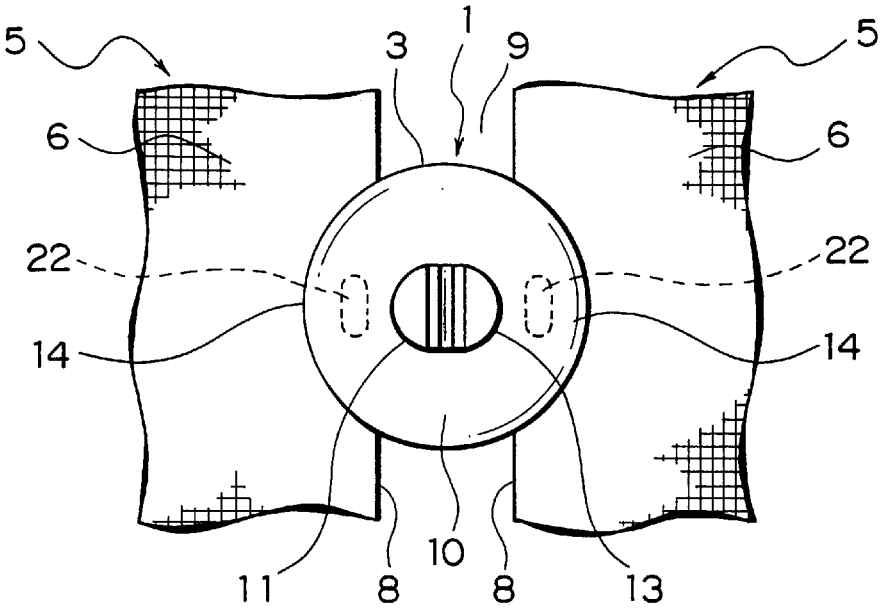
FIG. 8 is an enlarged front view of main portions of a snap with supports according to a fifth embodiment of the present invention.

In the snap with supports according to a fifth embodiment shown in FIG. 8, two tapes 6 are disposed with a gap 9 having a predetermined gap such that the tapes 6 are arranged in parallel. Then, a male body 2 of the snap 1 made of thermoplastic resin is attached on opposing edges 8 of the tapes 6 by integral molding. An elongated-circle shaped through hole 22 is made in the vicinity of each of the opposing edges 8 of the tape 6 and circular nipping portions 14 of the male body 2 are disposed on the through holes 22. Front and rear portions of the nipping portions 14 are joined through the elongated-circle shaped through holes 22 so as to attach the male body 2 of the snap 1 on the opposing edges 8 of a pair of the tapes 6.

In case of the snaps 1 shown in FIGS. 7 and 8, the large-size snap 1 may be formed while pinning the tape 6 therein at the time of injection molding in order to prevent a generation of the undulation of the edges of the tapes 6, without providing the edges of the tape 6 with the through holes 22. In this case, the position of the through holes shown in FIGS. 7, 8 is the most suitable. Further, the base 10, 16 of the snap 1 may be not only square, but also circular or polygonal or elliptical.

Figure 9:
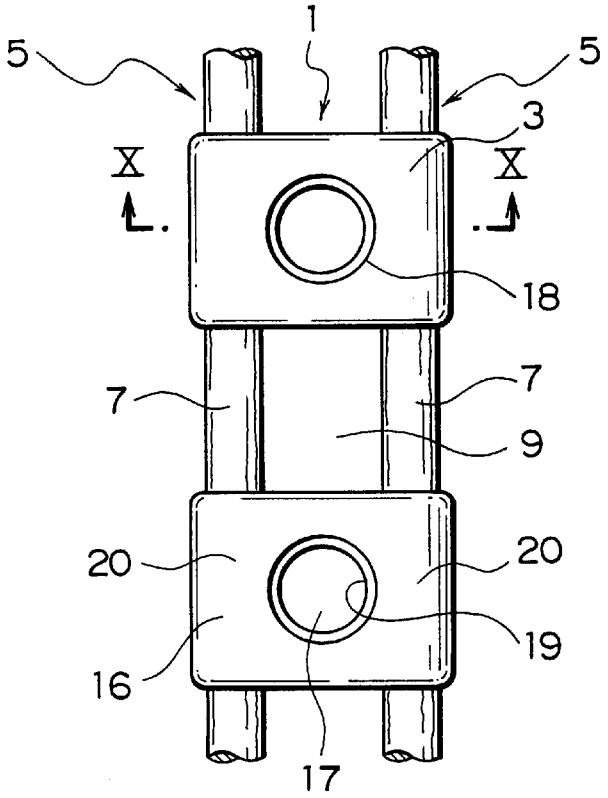
FIG. 9 is a front view of a snap with supports according to a sixth embodiment of the present invention.
Figure 10:
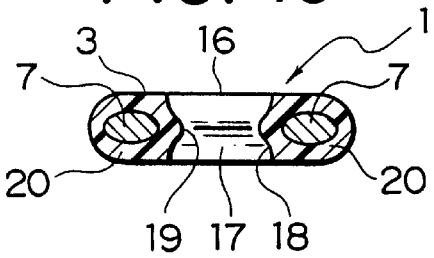
FIG. 10 is a sectional view taken along the line X—X of the snap with support of FIG. 9.

In the snap with supports of a sixth embodiment shown in FIGS. 9 and 10, a pair of strings 7 are used as the support 5 and the gap 9 is provided between the strings 7. The snap 1 of thermoplastic resin is attached over this gap 9 by integral molding. The string 7 is formed of woven string, knitted string or braided string of synthetic fiber having circular section, elliptical section or the like. Two pieces of the strings 7 having such a shape are arranged in parallel with the constant gap 9 and the snaps 1 of thermoplastic resin, that is the female bodies 3 of the snaps 1 as shown in FIGS. 9 and 10 are formed on the strings 7 at a constant pitch by injection molding means or extrusion molding means. Consequently, the string 7 is covered with and fixed by the nipping portions 20 of the snap 1. This snap with supports formed of the strings 7 is used in the same manner as the snap with supports formed of the tapes 6.

Figure 11:
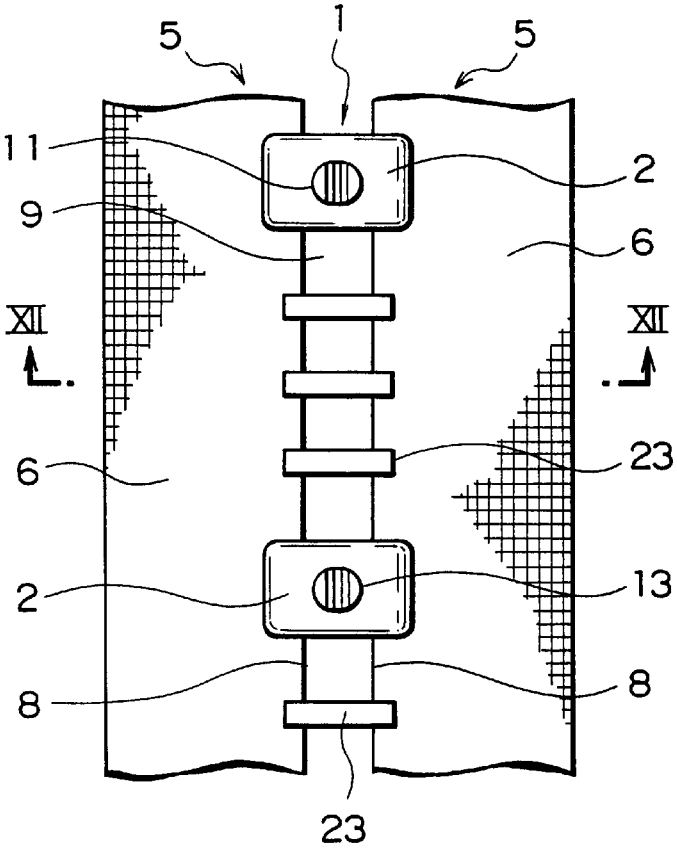
FIG. 11 is a front view of the snap with supports according to a seventh embodiment of the present invention.
Figure 12:
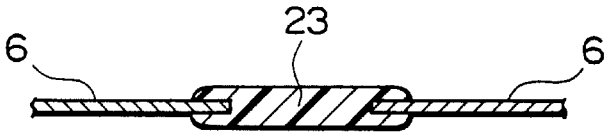
FIG. 12 is an enlarged sectional view taken along the line XII—XII of the snap with support of FIG. 11.
Figure 13:
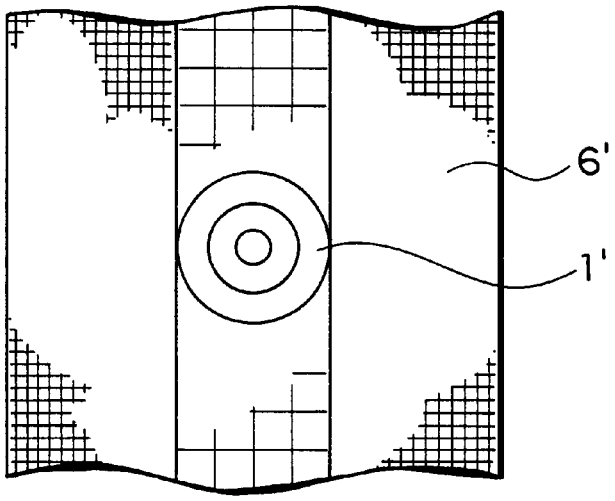
FIG. 13 PRIOR ART
FIG. 13 is an enlarged front view of main portions of a well known snap with support.

In the snap with supports of a seventh embodiment shown in FIGS. 11 and 12, the tapes 6 are used for the supports 5 and two tapes 6 are arranged with a predetermined distance so as to provide with the gap 9. The male bodies 2 of the snaps 1 are attached at a predetermined pitch on the opposing edges 8 of the tapes 6 and several bridge pieces 23 of thermoplastic resin are provided across the opposing edges 8 of the tapes 6 such that they are located between the longitudinally adjacent male bodies 2. The male bodies 2 and the bridge pieces 23 are formed by integral molding simultaneously.

Consequently, after the snap with supports is attached on an attaching portion of an opening/closing portion of clothes by sewing, opposing edges between the snap 1 and another snap 1 are prevented from floating from the attaching portion.

What is claimed is:

1. Snaps with supports, wherein at least either a plurality of male bodies or female bodies of the snaps composed of thermoplastic resin are attached by integral molding along a pair of supports being composed of long tapes and disposed in parallel opposing each other across a constant gap nipping opposing surfaces of each support at a predetermined pitch and across said gap.

2. The snaps with supports according to claim 1, wherein the gap formed between the opposing supports is at least larger than the size of an engaging head or an engaging hole of one of the snaps.

3. The snaps with supports according to claim 1, wherein opposing edges of the tapes are formed in enlarged edge portions.

4. The snaps with supports according to claim 1, wherein male bodies and female bodies of the snaps are disposed alternately on the opposing edges of the supports opposing each other.

5. The snaps with supports according to claim 1, wherein a through hole is provided in the vicinity of each of the opposing edges of the supports and a nipping portion of one of the snaps is formed on each of the through holes.

6. The snaps with supports according to claim 1, wherein at least one of the plurality of male bodies has an engaging post provided in the center of a flat base having nipping portions on both sides thereof, the engaging post comprising an engaging head provided on an outer peripheral face such that it is protruded, and at least one of the plurality of female bodies has an engaging hole provided in the center of a base having nipping portions on both sides thereof, the engaging hole being capable of engaging with the engaging head and having a protruded row provided in a peripheral wall of the engaging hole.

7. The snaps with supports according to claim 1, wherein at least either the plurality of male bodies or the plurality of female bodies of the snaps are disposed on the opposing edges of the supports opposing each other and bridge pieces of thermoplastic resin are disposed on the opposing edges such that they are located between the plurality of male or the plurality of female bodies.

* * * * *